US007954296B2

(12) United States Patent
Newland

(10) Patent No.: US 7,954,296 B2
(45) Date of Patent: Jun. 7, 2011

(54) RADIAL TETRAHEDRAL MODULAR STRUCTURES

(75) Inventor: Dennis John Newland, Puyallup, WA (US)

(73) Assignee: Dennis John Newland, Port Townsend, WA (US)

( * ) Notice: Subject to any disclaimer, the term of this patent is extended or adjusted under 35 U.S.C. 154(b) by 146 days.

(21) Appl. No.: 12/407,956

(22) Filed: Mar. 20, 2009

(65) Prior Publication Data

US 2010/0236184 A1 Sep. 23, 2010

(51) Int. Cl.
*E04B 1/19* (2006.01)

(52) U.S. Cl. ..... 52/655.1; 52/645; 403/170; 403/173; 403/176

(58) Field of Classification Search ..... 52/653.1, 52/645, 646; 403/126, 169.1, 171, 172, 173, 403/176

See application file for complete search history.

(56) References Cited

U.S. PATENT DOCUMENTS 1,851,159 A * 3/1932 Dodge ..... 434/278
3,563,580 A * 2/1971 Black ..... 403/172
3,694,954 A * 10/1972 Brumlik ..... 446/102
3,830,011 A * 8/1974 Ochrymowich ..... 446/126
4,080,925 A * 3/1978 Moore ..... 116/200
4,288,947 A * 9/1981 Huang ..... 52/2.15
4,446,666 A 5/1984 Gilman
4,778,184 A * 10/1988 Fleischer ..... 273/155
5,125,206 A * 6/1992 Motohashi et al. ..... 52/646
5,129,279 A * 7/1992 Rennex ..... 74/490.05
5,448,868 A * 9/1995 Lalvani ..... 52/648.1
RE35,085 E * 11/1995 Sanderson ..... 52/655.1
5,542,871 A * 8/1996 Gabriel ..... 446/126
5,701,713 A * 12/1997 Silver ..... 52/645
6,309,581 B1 10/2001 Gervasi
6,612,086 B2 * 9/2003 Pitt ..... 52/665
6,641,897 B2 11/2003 Gervasi
6,869,246 B2 * 3/2005 Bridgers ..... 403/229
7,694,486 B2 * 4/2010 Murphy et al. ..... 52/645
7,766,796 B2 * 8/2010 Pizmony ..... 482/35
2008/0168981 A1 * 7/2008 Cummings et al. ..... 126/600

* cited by examiner

*Primary Examiner* — Eileen Lillis
*Assistant Examiner* — Alp Akbasli

(57) ABSTRACT

A new connecting node set that is unique and surprisingly effective at aligning interfacing holes in connecting nodes is illustrated by their application to radial tetrahedral structures. This method of connecting one node to another requires that a left handed node be connected to a right handed node. They are called left handed or right handed because their lines of interface in at least two directions of intended use are geometrically coincident with straight line rulings of a hyperboloid of revolution of one sheet which itself consists of two families of straight line rulings, designated a left handed and a right handed family respectively. With these nodes, magnets could be placed on the lines of interface (opposite placement in a left handed one from a right handed one) and thus the magnets would always attract or repel as preferred.

2 Claims, 8 Drawing Sheets

RADIAL TETRAHEDRAL MODULAR STRUCTURES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates to modular single piece structures capable of being connected to similar modular structures or to other structures to create composite structures.

2. Prior Art

There are many examples of modular structures capable of being connected to each other or to other structures such as the steel pieces used in the framing of houses or concrete barricades that can be connected at each end and strung together to form a long connected barrier. Also there are many connecting nodes in use today such as the prior art illustrated in FIG. 3A. This application describes improvements in the field of modular structures and their connecting nodes. In particular the radial tetrahedral structures with their left and right handed connecting nodes provides for these modular structures to be connected in an adjacent configuration as well as a stacked configuration with the same parts. This dual configuration attribute is a distinct improvement over the prior art and has many advantages. Advantages include the ability to strengthen joints or corners as well as to strengthen an entire structure. These strengthening advantages could be added after the original structure is built as an add-on upgrade not requiring the original structure to be taken down. Another advantage is that left and right handed versions of these structures are readily adaptable to the use of magnets as the connecting mechanism instead of something like a bolt as the magnetic poles can be placed such that they always attract at the left and right handed node interfaces. The radial tetrahedral structures of this application are more versatile than the prior art.

SUMMARY

The radial tetrahedral structures consist of four spokes radiating outward from a hub at the center of a tetrahedron with each spoke terminating in a connecting node at one of the four vertices of the tetrahedron. This results in versatile modular structures that can be used to extend into all three spatial dimensions just as cubes could be stacked to produce a multidimensional stack of any shape that results from the addition of more cubes. For example, a radial tetrahedral structure could be assembled to replace the common 2 by 4 piece of wooden lumber in everyday use. A unique and surprising attribute of these modular structural components is that they can be assembled in a stacked configuration in addition to an adjacently connected configuration. Providing new, unique and extensive versatility, the stacked components also occupy a cubic or rectangular envelope and can be connected to other radial tetrahedral structures which are themselves in either a stacked or an adjacent configuration. Additionally the stacked attributes can be added onto already existing structures without dismantling the original structure. This add-on capability could be utilized to strengthen corners, crossings and any or all other parts of an original radial tetrahedral modular structure.

DRAWINGS

Figures

In the drawings, closely related figures have the same number but different alphabetic suffixes. Also all holes in the nodes line up with holes in nodes of components behind, to the side or above or below i.e. there is a clear line of sight through the holes of lined up nodes in all these figures. The a×b×c nomenclature used in this application refers to the overall envelope of the structure and means "a" cubes high by "b" cubes wide by "c" cubes deep with each cube being the same size.

DRAWINGS—REFERENCE NUMERALS

Figure 1A:
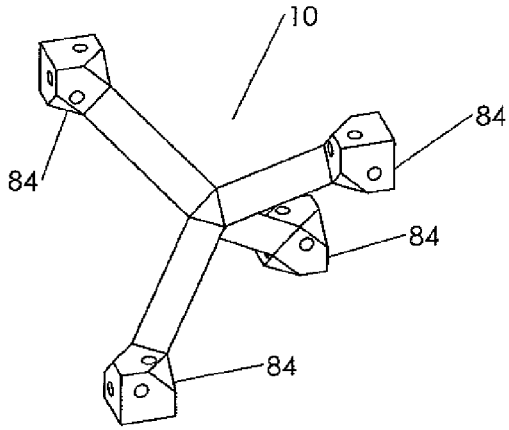
FIG. 1A illustrates a left handed radial tetrahedral structure with left handed nodes i.e. a 1×1×1 structure.

10 Left handed radial tetrahedral structure with left handed nodes

20 Right handed radial tetrahedral structure with right handed nodes

30 A 1×2×2 radial tetrahedral structure

40 A 1×2×6 radial tetrahedral structure

50 A 2×2×2 radial tetrahedral structure with a rhombic dodecahedral polygon enclosing a central volume

60 A 2×2×2 radial tetrahedral structure with half rhombic dodecahedral polygons facing outward on each of its six faces

70 Four stacked 1×2×2 radial tetrahedral structures yielding a 2×2×2 structure

78 Prior art node

80 Left handed node

82 Right handed node

84 Left handed node holes whose axes are left handed rulings of a hyperboloid of revolution of one sheet

86 Right handed node holes whose axes are Right handed rulings of a hyperboloid of revolution of one sheet

88 The diagonal of the cubic node around which the holes are arranged on the surface of a hyperboloid of revolution of one sheet—the diagonal being the axis of the hyperboloid of revolution of one sheet and this diagonal also points to the center of the tetrahedron when attached to the spoke of the radial tetrahedral structures

Figure 1B:
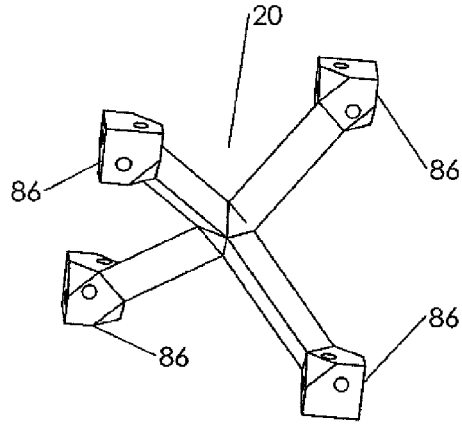
FIG. 1B illustrates a right handed radial tetrahedral structure with right handed nodes i.e. a 1×1×1 structure.

DETAILED DESCRIPTION—First Embodiment—FIGS. 1A AND 1B

The radial tetrahedral structures consist of four spokes radiating outward from a hub at the center of a tetrahedron with each spoke terminating in a connecting node near one of the four vertices of the tetrahedron. The spoke design is necessary to allow stacked connection of these components in all three x, y and z directions in addition to connection in an adjacent configuration. The stacked configuration is discussed in the second embodiment described below. The connecting nodes of this embodiment are cubic in shape and reside in four of the eight corners of a larger cubic envelope which surrounds the entire radial tetrahedral structure. Other geometric envelopes housing the four spokes and their connecting nodes are possible. With the cubic envelopes of this embodiment, the resulting radial tetrahedral structures can be connected at any of their six cubic envelope faces. This results in the capability to build any composite structure that can be subdivided into cubes. For example a number of these radial tetrahedral structures could be combined to replace the commonly used 2×4 piece of wooden lumber.

Figure 3A:
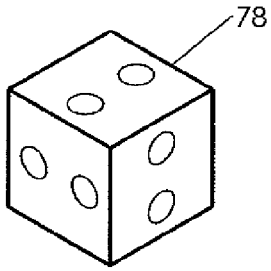
Fig. 3A Prior Art
FIG. 3A shows a prior art node containing two holes in each of the x, y and z directions.
Figure 3B:
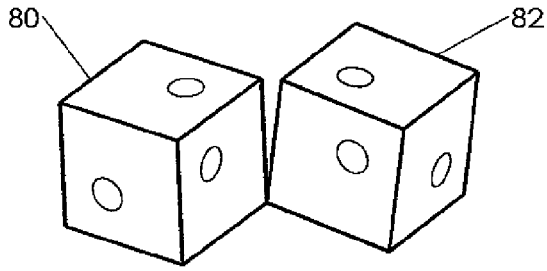
FIG. 3B shows left handed and right handed nodes which have one hole in each of the x, y and z directions.

The connecting nodes illustrated in this first and then the second embodiment described below show the use of a node that utilizes holes to provide something similar to a bolted connection. While these nodes themselves are a separate improvement over prior art (in addition to the radial tetrahedral structures) they are not the only type of connecting node that could be used with the radial tetrahedral structures. Correspondingly the nodes could be used on structures other than the radial tetrahedral structures of these embodiments. The combination of the radial tetrahedral structure with the left and right handed nodes offers some collective advantages over and above their individual attributes thus this combination is illustrated in these embodiments. Use of these improved nodes requires that a left handed version of a radial tetrahedral structure be connected to a right handed version as discussed below. FIG. 1A illustrates the left handed radial tetrahedral structure and FIG. 1B illustrates the right handed radial tetrahedral structure. They are termed left and right handed because their spokes terminate in the left and right handed nodes of FIG. 3B respectively. The necessity for left and right handed version results from the node design where only a single hole in each direction of intended use is provided. To enable connecting these radial tetrahedral structures to each other the connecting nodes must be capable of aligning their holes in the x, y and z directions (using the nomenclature of the common Cartesian coordinate system). Additionally it is often desirable to keep the connecting nodes small yet capable of accommodating as large a bolt as practical for strength purposes and since working with tiny bolts is more difficult than the larger ones that can be readily placed and initially fastened with human hands. Thus having only one hole through each face means that the hole can be large and the face (and thus the overall node) can be small since it only needs to accommodate one bolt head or nut not two or more as in the example of a prior art node, FIG. 3A.

Figure 2A:
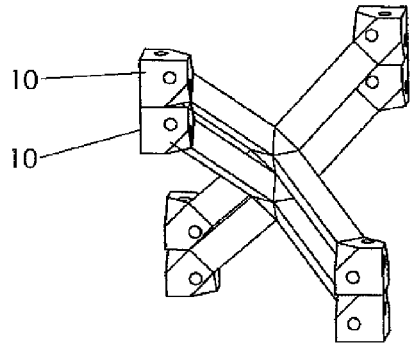
FIG. 2A illustrates how two left handed radial tetrahedral structures can be stacked i.e. a 1¼×1×1 structure.
Figure 2B:
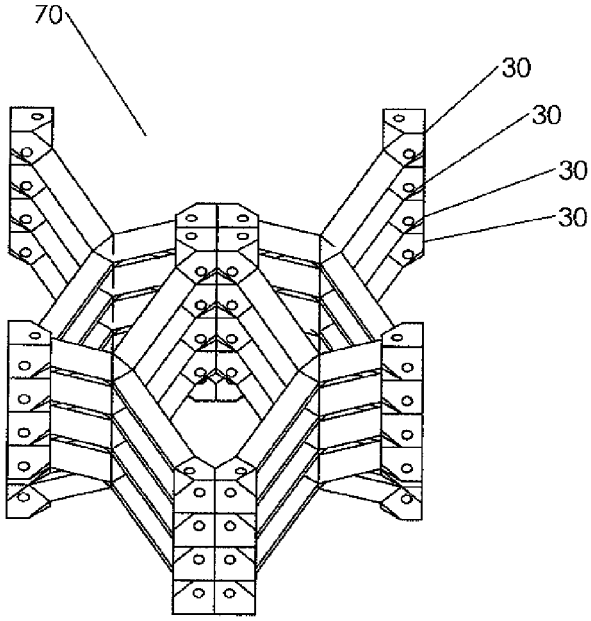
FIG. 2B illustrates how four of the structures of FIG. 1D can be stacked i.e. a 2×2×2 stacked structure.
Figure 3C:
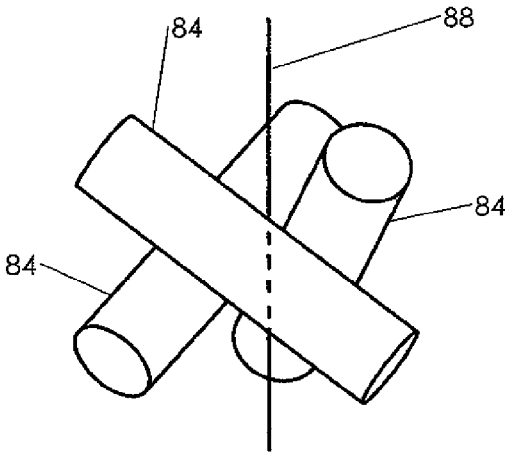
FIG. 3C shows the volume of the holes of a left handed node leaning to the left as they are arranged around a diagonal of a left handed node showing that the hole axes are left handed rulings of a hyperboloid of revolution of one sheet.

The left handed and right handed connecting nodes of FIG. 2B have only one hole in each face thereby achieving the design objectives described above and provide the ability to align holes in the x, y and z directions. With the need to provide a hole in three directions not all holes could pass through the center of the node since a bolt in one hole would then block bolt placement into either of the other two holes. To provide a hole configuration optimized to place the holes as close to the center as possible (valuable to minimize node size and to minimize torque from structural loads) and to be able to align their holes, the left handed and right handed nodes of FIG. 2B were devised. FIG. 3C shows how the holes of the left handed node lean to the left as they surround the particular cubic diagonal of the node which will point to the center of the tetrahedron when the nodes are placed onto the spokes of the radial tetrahedral structures. The axes of these holes are left handed rulings of a hyperboloid of revolution of one sheet whose curvature is such that the three hole axes are mutually orthogonal and then can provide the necessary hole alignment in the x, y and z directions. Correspondingly the hole axes of FIG. 3D are right handed rulings of the same hyperboloid of revolution of one sheet and also provide mutually orthogonal hole axes and the necessary hole alignment of a right handed node in the x, y and z directions.

These left handed and right handed tetrahedral structures with their unique connecting nodes offer the opportunity to use magnets as the connecting mechanism rather than something like a bolt. A rod magnet could be placed into the hole(s) of left handed radial tetrahedral structure with the south pole at the interfacing face. Correspondingly, a rod magnet could be placed into the hole(s) of a right handed radial tetrahedron with its north pole at the interfacing face. Thus when adjacent left and right handed units are brought together the magnets would always attract thereby connecting them.

Figure 3D:
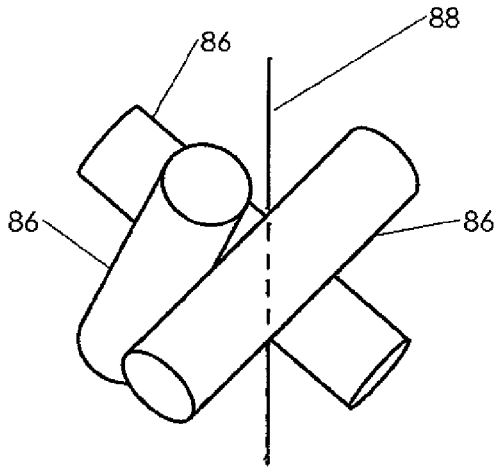
FIG. 3D shows the volume of the holes of a right handed node leaning to the right as they are arranged around a diagonal of a right handed node showing that the hole axes are right handed rulings of a hyperboloid of revolution of one sheet.

Accepting the limitation whereby a left handed node must always connect to a right handed node allows the advantages of the single hole nodes as described above and surprisingly, a hole design could be devised which assures that the holes of a left handed node are always properly aligned with the holes of an interfacing right handed node when the nodes are mounted onto the spokes with the node cubic diagonals shown in FIGS. 3C and 3D pointing toward the center of the radial tetrahedral structures of FIGS. 1A and 1B. When constructed as describe above, any of the three interfacing faces (one face in each of the x, y and z directions) of a left handed node will exactly align its holes with any of the three interfacing faces of a right handed node. This also results in the capability wherein a left handed radial tetrahedral structure as in FIG. 1A can be attached to a right handed radial tetrahedral structure as in FIG. 1B in any of six places and vice versa (one connection site for each of the six faces of the enclosing cubic envelopes of the radial tetrahedral structures).

Figure 1C:
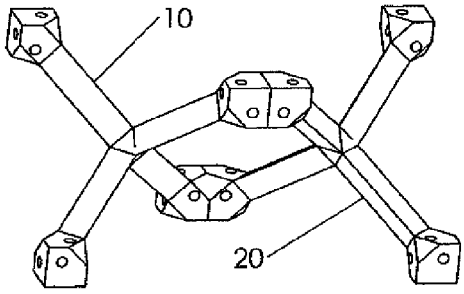
FIG. 1C illustrates one left handed radial tetrahedral structure connected to one right handed tetrahedral structure i.e. a 1×1×2 structure.

Operation, First Embodiment—FIGS. 1C Though 1K

Figure 1D:
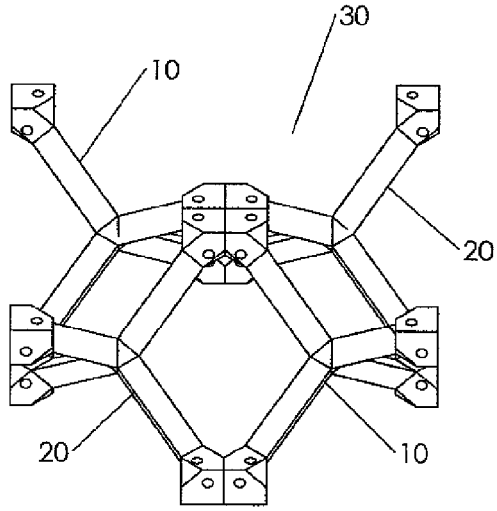
FIG. 1D illustrates two left handed radial tetrahedral structures alternately connected to two right handed radial tetrahedral structures i.e. a 1×2×2 structure.
Figure 1E:
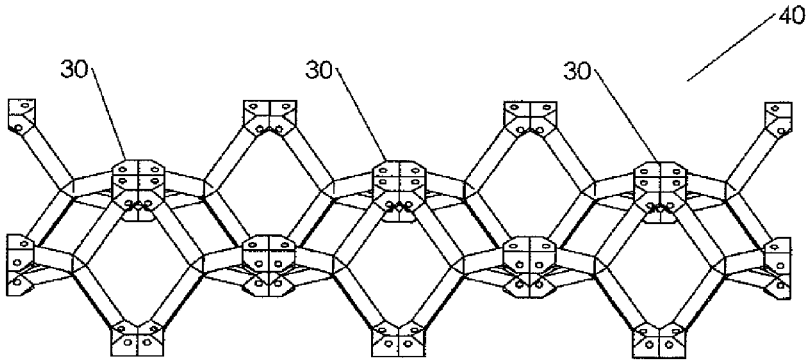
FIG. 1E illustrates three of the structures of FIG. 1D connected in a line i.e. a 1×2×6 structure.
Figure 1F:
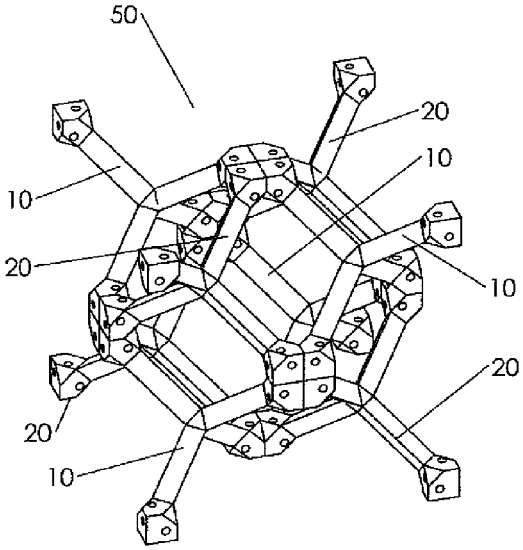
FIG. 1F illustrates two of the structures of FIG. 1D connected in a configuration with a rhombic dodecahedral polygon surrounding the central volume i.e. a 2×2×2 structure.
Figure 1G:
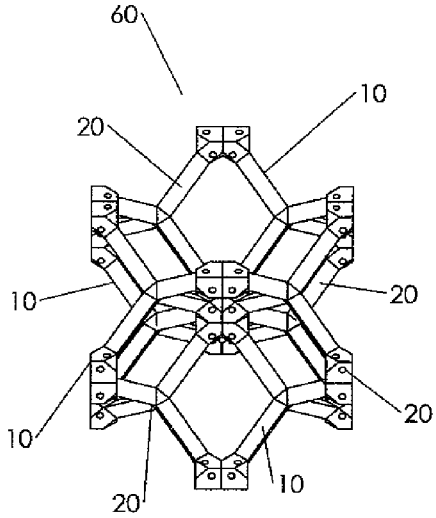
FIG. 1G illustrates two of the structures of FIG. 1D connected in a configuration that has six half rhombic dodecahedral polygons facing outward i.e. a 2×2'32 structure with the components of FIG. 1D in a different configuration than those of FIG. 1F.
Figure 1H:
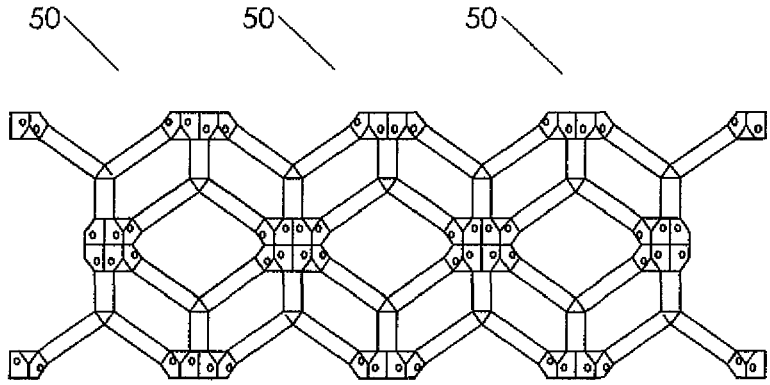
FIG. 1H illustrates three of the structures of FIG. 1F connected in a line.
Figure 1I:
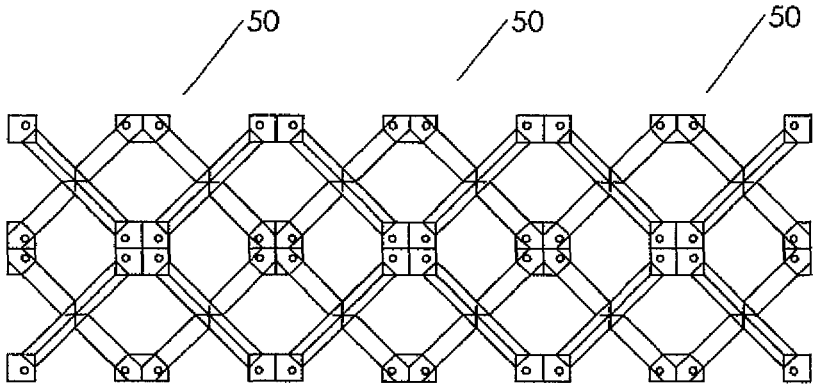
FIG. 1I is a top view of the structure of FIG. 1H showing that all holes line up from top to bottom.
Figure 1J:
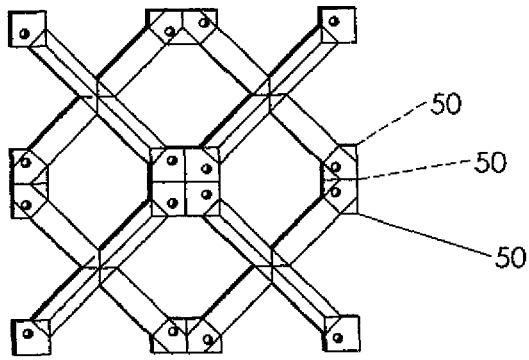
FIG. 1J is a side view of the structure of FIG. 1H showing that all holes line up from side to side.
Figure 1K:
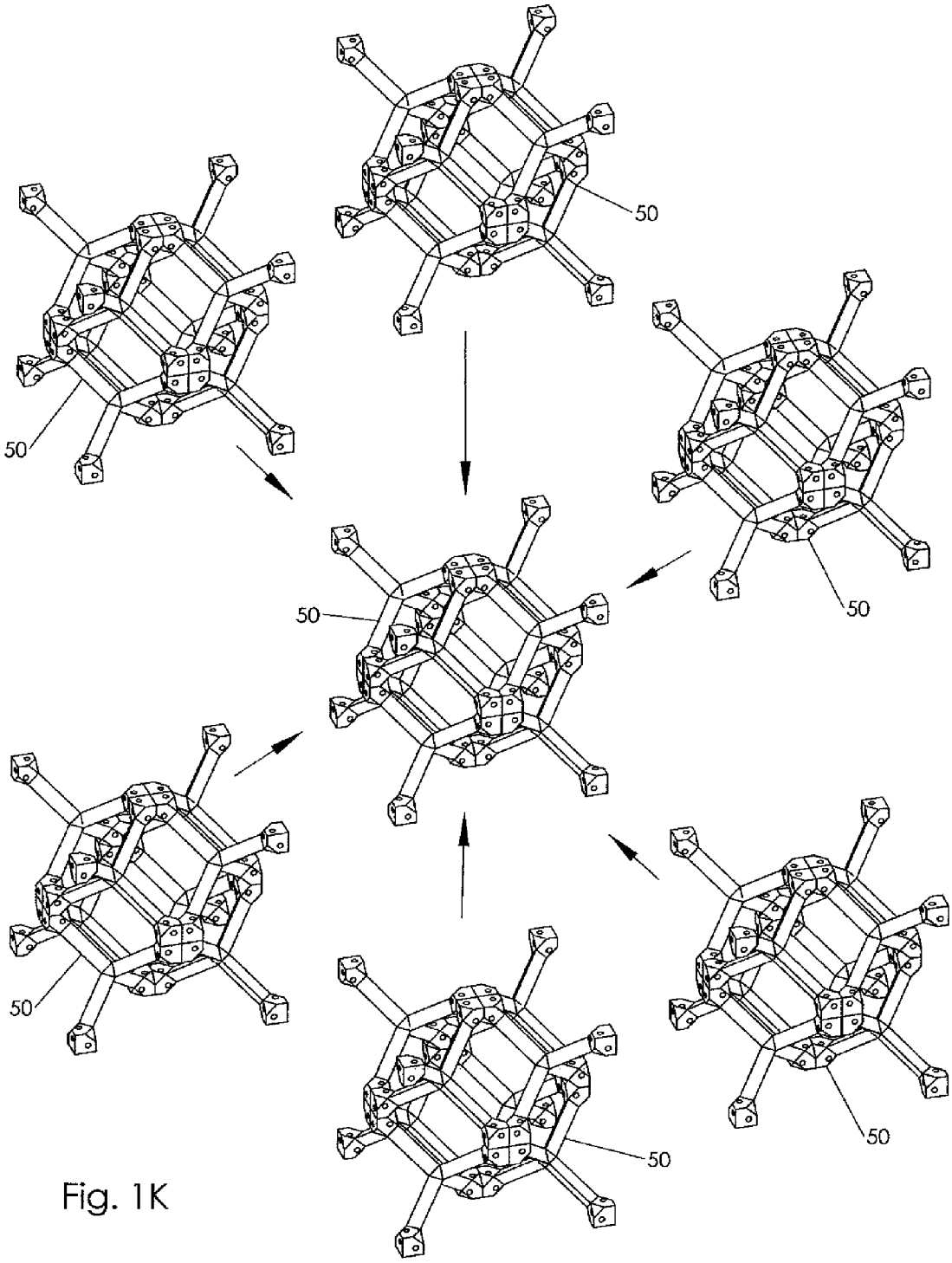
FIG. 1K shows how six of the structures of FIG. 1F could be attached to the six faces of a seventh structure of FIG. 1F creating a three dimensional crossing structure.

Once the left handed and right handed radial tetrahedral structures of FIGS. 1A and 1B are constructed they can be connected adjacently in any of six places, one connection site for each of the six faces of the enclosing cubic envelopes of the structures. FIG. 1C shows one left handed radial tetrahedral structure connected to one right handed radial tetrahedral structure resulting in a 1×1×2 structure (the numbers are the number of cubes high by the number of cubes wide by the number of cubes deep with the cubes being of the same size). FIG. 1D shows the combination of two of the structures of FIG. 1C resulting in a 1×2×2 structure. Continuing, FIG. 1E shows the combination of three of the structures of FIG. 1D resulting in a 1×2×6 structure. FIG. 1F shows two of the structures of FIG. 1D combined into a 2×2×2 structure which has a rhombic dodecahedral polygon surrounding a central volume. FIG. 1G shows two of the structures of FIG. 1D but this time they are connected differently, still resulting in a 2×2×2 structure whereas this time there are six half rhombic dodecahedral polygons facing outward. FIG. 1H shows two of the structures of FIG. 1E connected in a manner that results in three rhombic dodecahedral enclosed volumes and is a 2×2×6 structure. FIG. 1I is the top view of FIG. 1H showing that all holes line up when viewed from this perspective. FIG. 1J is the side view of FIG. 1H showing that all holes line up when viewed from this perspective also. FIG. 1K shows how six of the 2×2×2 structures of FIG. 1F could be attached to the six faces of a seventh structure of FIG. 1F creating a three dimensional crossing structure.

These Figures represent only a small fraction of the combinations that can be made from the left handed radial tetrahedral structure of FIG. 1A and the right handed radial tetrahedral structure of FIG. 1B. Essentially, any structure that can be subdivided into cubes can be made up of a combination of the left and right handed radial tetrahedral structures of FIGS. 1A and 1B.

DETAILED DESCRIPTION—Second Embodiment—FIGS. 2A Through 2F

The second embodiment is stacked configurations resulting from the combination of radial tetrahedral structures. The stacking attribute of these structures is enabled by the radial spoke design of the radial tetrahedral structures. With the spoke design these structures have the materials of construction located in a limited volume such that the materials of construction do not interfere with the stacking of these components in any of the three x, y and z directions. Unlike the adjacent configurations of the first embodiment where adjacent combinations of the components of FIGS. 1A and 1B must be alternately left and right handed, when structures resulting from the combinations of the components of FIGS. 1A and 1B are stacked, they stack left to left and right to right. The resulting stacks are still cubic or rectangular in dimension and can be connected either to other stacked components or they can be connected to adjacent structures of the first embodiment. The node holes all line up in a stacked configuration just as they did in an adjacent configuration. The stacking of these structures allows the strengthening of a structure that occupies a given volume. For example if the node size is chosen to be one fourth the size of the cubic envelope which surrounds one of the radial tetrahedral structures of FIG. 1A or 1B then four structures can be stacked in the same volume as two of the adjacent structures of the first embodiment (see further discussion of the operation of this embodiment below). Choice of a node size such that an integer number of structures can be stacked within the pertinent dimensions of an adjacently configured radial tetrahedral structure is advantageous as this provides for the alignment of holes with interfacing radial tetrahedral structures. Stacking provides a second method of construction using only stacked components or they can be used to strengthen a corner or an intersection or an entire structure composed of combinations of the structures of the first embodiment.

This stacking attribute of these radial tetrahedral structures can be utilized as an add-on upgrade to an already existing radial tetrahedral structure to improve strength in parts or all of the original structure. The original structure need not be dismantled to add additional strengthening radial tetrahedral structures. Thus these structures are versatile in that they can be readily modified.

Operation, Second Embodiment—FIGS. 2A T*hrough* 2G

Figure 2C:
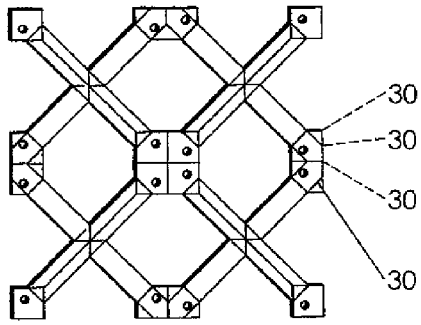
FIG. 2C is a top view of FIG. 2B showing that all holes line up vertically.
Figure 2D:
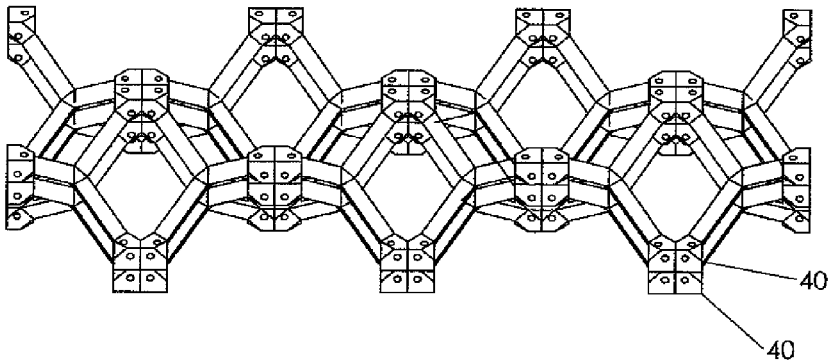
FIG. 2D illustrates two of the structures of FIG. 1E stacked i.e. a 1¼×2×6 stacked structure.
Figure 2E:
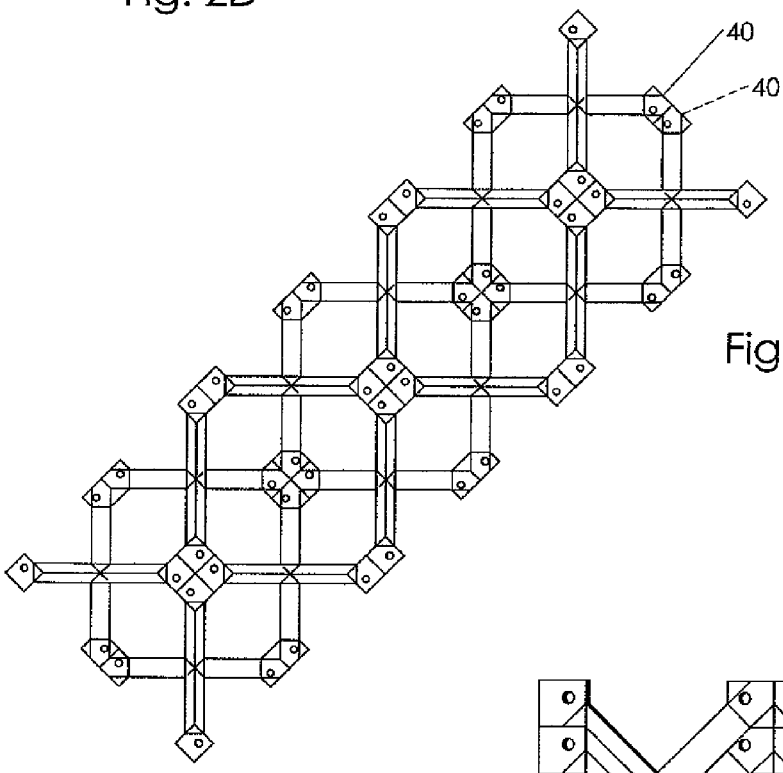
FIG. 2E is a top view of FIG. 2D showing that all holes line up vertically.
Figure 2F:
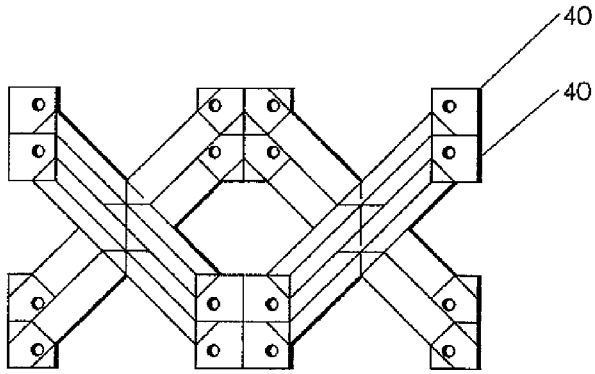
FIG. 2F is a side view of FIG. 2D showing that all holes line up from side to side.
Figure 2G:
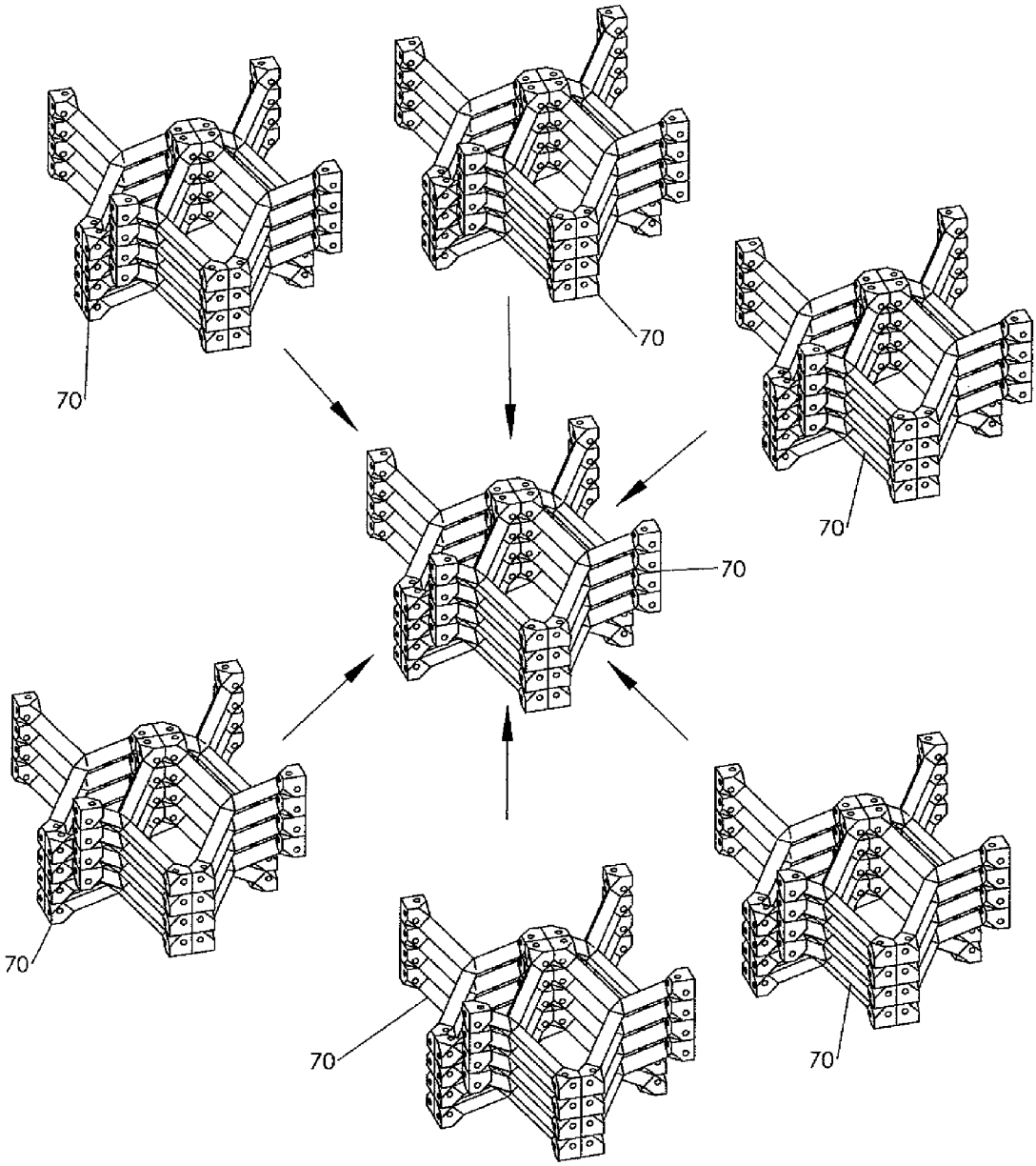
FIG. 2G shows how six stacked structures of FIG. 2B could be attached to the six faces of a seventh stacked structure of FIG. 2B creating a three dimensional crossing structure.

FIG. 2A shows how two of the radial tetrahedral structures of FIG. 1A can be stacked which results in a 1¼×1×1 structure. FIG. 2B illustrates the stacking of four of the components of FIG. 1D. This stacking results in a 2×2×2 structure, this structure occupies the same volume as the 2×2×2 structures of FIG. 1F or 1G and holes align so that, for example, the stacked structure of FIG. 2B can be connected to the adjacently configured structures of FIG. 1F or 1G. FIG. 2C is a top view of FIG. 2B showing that all of the holes line up. A side view would also show that all holes line up from that perspective. FIG. 2D shows the stacked combination of two of the components of FIG. 1E resulting in a 1¼×2×6 structure. FIG. 2E is a top view of FIG. 2D showing that all holes line up when viewed from this perspective. FIG. 2F is a side view of FIG. 2D showing that all holes line up when viewed from that perspective also. FIG. 1G shows how six of the stacked structure of FIG. 2B can be attached to a seventh stacked structure of FIG. 2B resulting in a three dimensional crossing structure. The holes in these stacked structures line up to enable connection of stacked structures to other stacked structures or to the adjacently configured structures of the first embodiment.

Advantages

From the descriptions above a number of key advantages of these presently preferred embodiments become evident:

- The radial tetrahedral modular structures are more versatile than prior art in that they can be connected in a stacked configuration in addition to the adjacent configuration.
- They can be used to create any structure which can be subdivided into cubic or rectangular segments (other geometric units of subdivision are also possible).
- The stacking attributes of these structures allows the addition of more radial tetrahedral structures to an already existing radial tetrahedral structure without dismantling the original structure. Thus strengthening various parts or all of an existing structure can be done as an add-on after the original construction.
- The actual material of construction occupies a minimal volume therefore they can readily be made to be lightweight structures.

The hole(s) in any interfacing face of a left handed radial tetrahedral structure always align with the hole(s) of any interfacing face of a right handed radial tetrahedral structure.

The left handed and right handed radial tetrahedral structures could readily use magnets as the attaching mechanism where they assure proper magnetic pole alignment to attract thereby connecting the left handed and right handed radial tetrahedral structures.

The connecting nodes at the extremities of the spokes emanating from the central hub of the radial tetrahedral structures can be made smaller than prior art since there is only one hole and the face size only has to accommodate one bolt head or fastener.

The holes in the connecting nodes can be located closer to the center of the nodes than prior art thus minimizing node size and torque resulting from structural loads.

Conclusions, Ramifications, and Scope

Accordingly the versatile radial tetrahedral modular structures and in particular the left handed and right handed radial tetrahedral modular structures with their unique connecting nodes can be used to attach modular components in either an adjacent or a stacked configuration, collective attributes not present in the prior art. Furthermore these nodes have additional advantages:

They can be made of metal, plastic, foam, ceramic, glass, wood, masonry or other materials.

They can be made in versions of any size with the limitation that generally one size version be used for the same set of structures.

They can substitute for many presently used structures such as the 2 by 4 piece of wooden lumber.

They could be used as toys, civil structures or other structures.

They can be made of materials of various colors or color combinations.

Although the descriptions above contain many specifics, these should not be construed as limiting the scope of the embodiments but as merely providing illustrations of some of the presently preferred embodiments. For example the ratios of node size to overall radial tetrahedral structure size could be chosen to enable stacking of five or six or some other number of radial tetrahedral structures in a given cubic or rectangular envelope rather than the four stacked in the embodiments above. Another example would be constructing these radial tetrahedral structures to be enclosed by a rectangular or space filling tetrahedral or some other geometry rather than cubic envelope.

I claim:

1. A joint for connecting node sets of tetrahedral structures comprising:

a pair of nodes, each said node having first, second, and third faces which oppose fourth, fifth and sixth faces respectively, one of the nodes is a left handed node and the other is a right handed node;

at least first, second, and third holes on the corresponding first, second, and third faces of each of the nodes extend therethrough creating first, second and third pathways to the opposing fourth, fifth, and sixth faces;

wherein the axes of the pathways of said left handed node correspond to a left handed ruling line of a hyperboloid of revolution of one sheet whose curvature is such that the longitudinal axes of said pathways are mutually orthogonal and such that said first, second, and third pathways are aligned in first, second, and third directions so to not intersect;

wherein the axes of the pathways of said right handed node correspond to a right handed ruling line of a hyperboloid of revolution of one sheet whose curvature is such that the longitudinal axes of said pathways are mutually orthogonal and such that said first, second, and third pathways are aligned in first, second, and third directions so to not intersect; and wherein said first hole on said first face of said left handed node and said first hole on said first face of said right handed node are directly aligned with one another and said first surfaces adjoin creating a matching line of interface between said surfaces.

2. The joint of claim 1, wherein the left handed and right handed connecting nodes are attached to structural components; and wherein said structural components can be connected to one or more sets of structural components at said left handed and right handed connecting nodes.

* * * * *